United States Patent [19]

Foshee

[11] Patent Number: 4,836,001

[45] Date of Patent: Jun. 6, 1989

[54] HIGH SECURITY LOCK

[75] Inventor: William R. Foshee, Noblesville, Ind.

[73] Assignee: Best Lock Corporation, Indianapolis, Ind.

[21] Appl. No.: 55,185

[22] Filed: May 28, 1987

Related U.S. Application Data

[63] Continuation of Ser. No. 718,538, Apr. 1, 1985, abandoned.

[51] Int. Cl.[4] ..... E05B 27/00; E05B 29/00

[52] U.S. Cl. ..... 70/368; 70/367

[58] Field of Search ..... 70/367, 368, 380, 224, 70/379 R, 370, 222, 223, 371

[56] References Cited

U.S. PATENT DOCUMENTS

| | | | |
|---|---|---|---|
| 1,714,423 | 5/1929 | Jacobi | 70/368 |
| 2,059,694 | 11/1936 | Jacobi | 70/368 |
| 2,073,583 | 3/1937 | Olson | 70/368 |
| 2,744,405 | 5/1956 | McClelland | 70/368 |
| 3,402,582 | 9/1968 | Jacobi | 70/371 |
| 3,882,699 | 5/1975 | Flack et al. | 70/368 |
| 4,222,253 | 3/1980 | Peitsmeier | 70/368 |
| 4,435,967 | 3/1984 | Best et al. | 70/224 |
| 4,545,223 | 10/1985 | Poutiainen et al. | 70/368 |

FOREIGN PATENT DOCUMENTS

| | | | |
|---|---|---|---|
| 1553311 | 9/1969 | Fed. Rep. of Germany | 70/368 |

*Primary Examiner*—Gary L. Smith
*Assistant Examiner*—Vinh Luong
*Attorney, Agent, or Firm*—Barnes & Thornburg

[57] ABSTRACT

A lock includes a lock housing and an interchangeable core including a core body, a core sleeve, and a key plug having a key slot. A bridge member is provided on a flange of the key-way disc to cover a portion of the longitudinal opening of the key slot in the key-way disc. In one embodiment, a cylinder cap is threadedly mounted on the lock cylinder housing to protect the core and a key-way disc is mounted in the cylinder cap to protect the key plug while still permitting insertion of an operating key into the key slot of the key plug. A spin-free pin is mounted for free rotation in the lock cylinder housing for blocking rotation of the protective cylinder cap in relation to the lock cylinder housing. A setscrew is provided in the lock cylinder housing to urge the spin-free blocking pin into rotation-blocking engagement with the threaded cylinder cap. In other embodiments, the cap is mounted on the lock core for removal therewith by a control key from a lock cylinder housing or a padlock case. In cases where the cap is used with a lock cylinder, a cylinder ring having a groove in an interior wall that opens toward either the cylinder cap or the lock cylinder is also provided. The exterior surface and the circumferential groove of the cylinder ring are case hardened.

11 Claims, 3 Drawing Sheets

HIGH SECURITY LOCK

This is a continuation of application Ser. No. 718,538, filed Apr. 1, 1985, now abandoned.

BACKGROUND AND SUMMARY OF THE INVENTION

This invention relates to lock construction and particularly to a high security lock for use in a mortise lockset, padlock, tubular locks, rim locks, or other specialty locks. More particularly, this invention relates to the construction of a lock assembly to reduce its vulnerability to destructive physical attack.

A convention mortise-type lock assembly includes a threaded cylinder housing which screws directly into mortise lock case and an interchangeable key removable lock core of "FIG.-8" construction removably mounted within the cylinder housing. A conventional padlock assembly includes a padlock case formed to include a pair of bores for receiving a shackle and a single cavity of FIG. 8 cross-section for receiving an interchangeable lock core.

A conventional lock cylinder assembly further includes a cylinder ring positioned on the lock cylinder housing to surround an exposed portion thereof to protect the lock cylinder housing and interchangeable core from attack. It is known to form a cylinder cap to include a hole alignable with the key plug in the lock cylinder housing to permit a user to insert a key into the key slot of the key plug through the aligned hole when a protective cylinder cap is used in a lockset. An assembly for a padlock is known to include a security harness of sturdy construction that is designed to enshroud the exterior of the padlock case to protect the interchangeable padlock core from destructive physical attack.

Notwithstanding the foregoing known lock features, the security of conventional locks can be violated in may different ways. Several lock-breaking techniques are explained in the following paragraphs. The improved lock of the present invention is specifically constructed to include several advantageous features which cooperate to frustrate the efforts of a lock-attacker who attempts to break the security of the improved lock and which simplify the construction and assembly of cylinder locks and padlocks. An object of the present invention is to provide a lock that will resist being opened by the application of a rotary force with tools: in the key slot, on the exposed part of a cylinder, or on the exposed portions of the lock assembly.

According to the present invention, a lock comprises a lock housing, and an interchangeabe core including a core body, a core sleeve, and a key plug having a key slot. A cap is mounted on the lock housing to protect the core, and a key-way disc is mounted in the cap to protect the key plug while still permitting insertion of an operating or control key into the key slot of the key plug.

The key-way disc includes a secondary key slot for alignment with the primary key slot of the key plug. The cap includes a disc-receiving passageway extending between an outer face and the inner face for alignment with the key plug. The cylinder cap includes a radially inwardly projecting lip in the passageway. The key-way disc includes a cylindrical member having an exterior cylindrical wall and a flange for engaging the cap lip to position the key-way disc in the disc-receiving passageway. The key slot of the cylindrical member opens radially outwardly through the exterior cylindrical wall of the disc. The flange includes a rib member extending radially outwardly from the exterior cylindrical wall of the cylinder portion, and a bridge member integrally coupled to the rib member. The bridge member covers a portion of the key slot opening in the cylinder member's exterior wall and is protectively captured intermediate the lip of the cap and an outer face of the lock core.

According to one preferred embodiment of the present invention, the cap is used with a lock cylinder and includes an inner face and a pin-receiving recess in the inner face. The cylinder cap is securely retained in a non-rotatable position on the lock cylinder housing due to the provision of a rotation-blocking means which is situated intermediate the cap and the lock cylinder housing. The cylinder cap is threadedly mounted on the lock cylinder housing to position the inner face of the cap in closely-confronting relation to an outer face of the lock cylinder housing to cause the pin-receiving recess to open toward the outer face of the lock cylinder housing. The lock cylinder housing includes a longitudinal bore having an opening in the outer face of the lock cylinder housing. A freely rotatable blocking pin is received in the bore. The spin-free blocking pin is extendable through the bore opening to engage the recess in the inner face of the cylinder cap. A setscrew is threadedly received in the lock cylinder housing bore and extendable therein to urge the spin-free blocking pin toward its engaged position in the cylinder cap. Thus, the setscrew of the present invention is protected by a free-spinning pin and is not susceptible to an attack of the type in which the setscrew is intercepted by a drill bit and rotated back into the lock cylinder housing land out of the threaded engagement with a protective cylinder cap. A cylinder ring having a drill-resistant circumferential groove is installable on the cylinder housing to protectively surround the cylinder cap.

According to another embodiment of the present invention, the cap is used with a lock cylinder and includes a cavity for receiving a forward portion of the core body and flange means for engaging the core body to position the cylinder cap in closely-confronting relation to an outer face of the lock cylinder housing when the interchangeable lock core is received in the lock cylinder housing. An upper lobe of the core body is formed to include a pair of lug-receiving slots. Each slot has an opening in an exterior surface of the upper lobe. The flange means includes a pair of lugs for engaging the slots in upper lobe of the core body. In this embodiment, the cylinder cap is conveniently removable from its cylinder-protecting position by means of the "control" key for the lock since the cylinder cap is carried on the core body of the interchangeable core and the core is itself removable from the lock cylinder by means of said "control" key. A cylinder ring having a drill-resistant circumferential groove is installable on the cylinder housing to protectively surround the cylinder cap.

According to yet another embodiment of the present invention, the cap is used with a padlock and includes a cavity for receiving a forward portion of the core body and flange means for engaging the core body to position an inner face of the padlock cap in communication with a core-receiving chamber formed in the padlock to protectively block at least a portion of the chamber opening and thereby provide a padlock security shield to protect a padlock core from being pulled, drilled, chiseled, or damaged using other methods during an attack. An upper lobe of the core body is formed to include a pair of lug-receiving slots. Each slot has an opening in the exterior surface of the upper lobe. The flange means includes a pair of lugs for engaging the slots in the upper lobe of the core body. In this embodiment, the padlock cap is removable from its recessed core-protecting position within the padlock case by means of the control key for the lock since the padlock cap is carried on the core body of the interchangeable core and the core is itself removable from the padlock case by means of said control key.

One feature of the present invention is the provision of spin-free means for blocking rotation of the protective cylinder cap in relation to the lock cylinder housing to prevent exposure of the lock core to attack. The spin-free means includes a setscrew and a freely rotatable blocking pin received in the longitudinal bore of the lock cylinder housing. The spin-free blocking pin advantageously prevents rotation and removal of the cylinder cap from its protective position on the lock cylinder housing by providing a blocking member that is not itself rotatably disengagable from the cylinder cap. In the absence of the novel freely rotatable blocking pin, destruction of a lone setscrew in threaded engagement with both the lock cylinder housing and the cylinder cap would be an easy task. Such destruction could be easily accomplished by drilling the forwardly presented face of the cylinder cap in the proper location to cause the drill bit to intercept the lone setscrew. The drill could then be operated to "back" the setscrew out of threaded engagement with the cylinder cap. Once the lone setscrew is disengaged from the cylinder cap, the lock-attacker could easily remove the protective cap and violate the security of the lock by picking or by the application of force. A lock-attacker seeking to violate the security of the improved lock of the present invention will soon learn that it is not possible to drill the face of the cylinder cap to intercept and rotatably "back" a lone setscrew from rotation-blocking engagement with the protective cylinder cap. Instead, the attack drill bit will intercept and rotate only the novel freely rotatable blocking pin. Thus, the setscrew of the present invention is insulated from attack since it only urges the spin-free blocking pin into engagement with the cap and does not threadably engage the protective cylinder cap.

Another feature of the present invention is the provision of a cylinder cap including flange means for engaging the lock core body to position the cylinder cap in closely-confronting relation to an outer face of the lock cylinder housing when the interchangeable lock core is received in the housing. This feature advantageously permits key removal of the cylinder cap to expedite disassembly of the lock for core replacement or recombination. In addition, this feature advantageously blocks rotation of the cylinder cap in respect to the lock cylinder housing during an attack.

Yet another feature of the present invention is the provision of a padlock cap including flange means for engaging the lock core body to position the cap in a recess in the padlock case to protect the interchangeable lock core body while it is received in its chamber in the padlock case. This feature advantageously permits key removal of the cap in a padlock environment to expedite disassembly of the lock for core replacement or recombination. Further, the placement of the padlock cap in a recess formed in the padlock case protects the core from being pulled with a "slam-puller," a "nose-puller," or other similar lock attack tool.

Still another feature of the present invention is the provision of a free-wheeling key-way disc to improve the pick-resistance and drill-resistance of a lock. The key-way disc provides an additional obstacle a lock-attacker must overcome during an attempt to pick the lock by hanging the segment pins on either the "operating" or "control" shearline. It is more difficult to insert a tension device into the key slot of a key plug when the key-way disc of the present invention is installed in a cylinder cap. Further, the key-way disc provides a barrier to prevent someone from drilling into the key plug.

Another feature of the present invention is the provision of a bridge member on the flange of the key-way disc. The bridge member is substantially inaccessible and hidden from view under a lip formed on the cap to prevent a lock-attacker from breaking the exposed part of the key-way disc with a chisel, collapsing the disc together about its key slot, and prying the disc out of the passage in the cap to gain access to the key plug.

Yet another feature is the provision of a cylinder ring having a groove in an interior wall that opens toward either the cylinder cap or the lock cylinder. Illustratively, the cylinder ring is formed to include a circumferential V-shaped groove that is heat-treated to provide a pair of heat-treated drill-resistant surfaces positioned to pose a pair of significant drill-thwarting obstacles during an attack on the cylinder ring. The cylinder ring is hardened so that it has a very hard outer surface and yet is not brittle and easily broken. The walls of the circumferential groove are hardened and provide a significant barrier to drilled attack. The security of a conventional cylinder lock can also be violated by destroying the cylinder ring to expose the cylinder and core to attack. This is often accomplished by drilling one or more holes into the forwardly presented face of the cylinder ring, splitting the ring along the drilled hole with a chisel, and driving a wedge into the split to break the cylinder ring apart. The drilled hole creates a stress riser in the conventional cylinder ring to permit a lock attacker to more easily crack through the ring with a chisel. The hardened groove walls of the improved cylinder ring cooperate to intercept and break a drill bit being used to drill a hole in the hardened forwardly presented face of the cylinder ring for the illicit purpose of creating a stress riser therein to more easily split and crack the cylinder ring.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
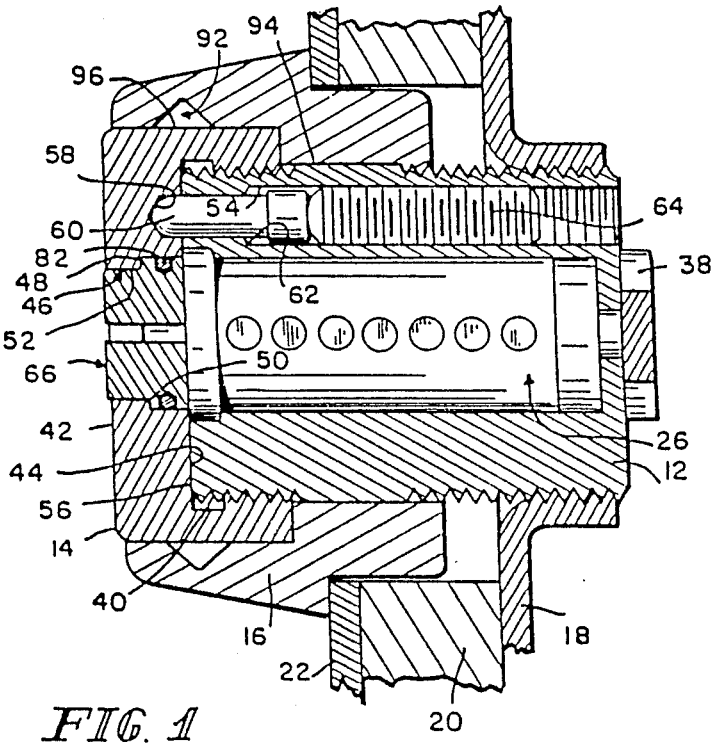
FIG. 1 is a longitudinal section of a lock incorporating one of the preferred embodiments of the present invention.
Figure 2:
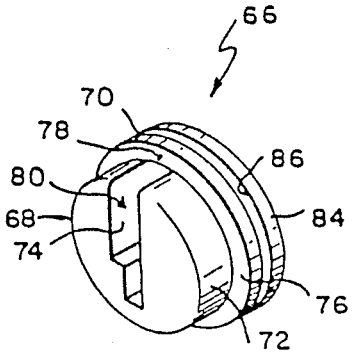
FIG. 2 is an enlarged isometric view of the freely rotatable key-way disc illustrated in FIGS. 1 and 4 showing the bridge member.
Figure 3:
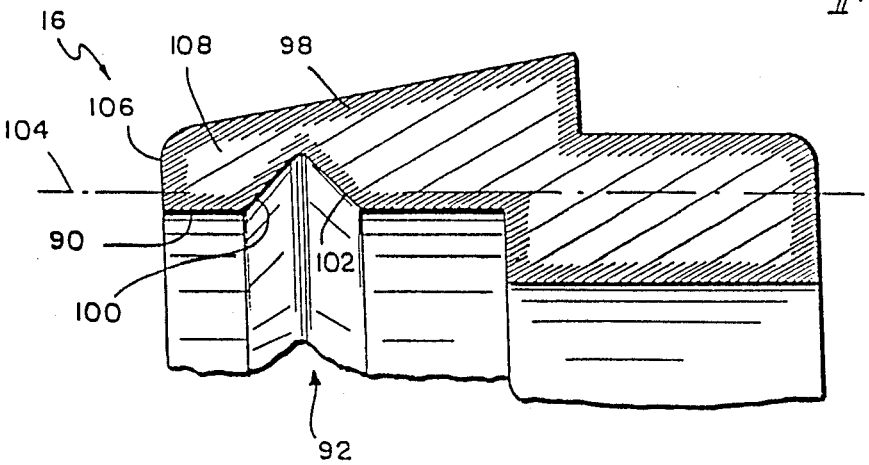
FIG. 3 is an enlarged view of the cylinder ring illustrated in FIGS. 1 and 4.
Figure 4:
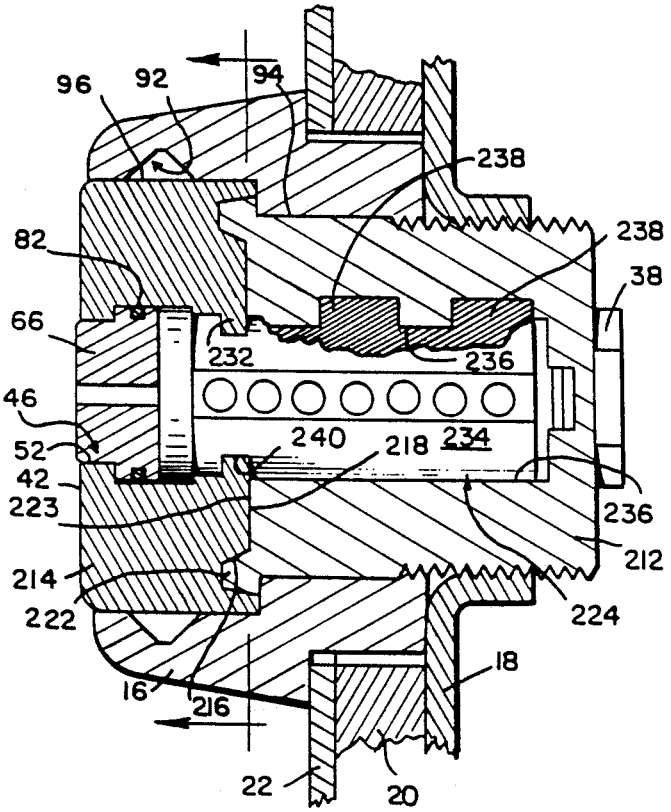
FIG. 4 is a longitudinal section of a lock incorporating another of the preferred embodiments of the present invention with portions broken away showing a key-removable cylinder cap mounted on an interchangeable lock core.

The lock shown in FIGS. 1–6 comprises a lock cylinder housing 12, a cylinder cap 14 and 214, and a cylinder ring 16. The lock is conveniently installable in the customary manner in the case 18 of a mortise lockset mounted in a door 20. It will be understood that the lock of the present invention shown in FIGS. 1–6 can be used in any application calling for a cylinder lock. As shown in FIGS. 1 and 4, the cylinder cap 14 is mounted on a forward portion of lock cylinder housing 12. The cylinder ring 16 is captured between the mounted cylinder cap 14 and an escutcheon 22 positioned on the door 20.

Figure 1A:
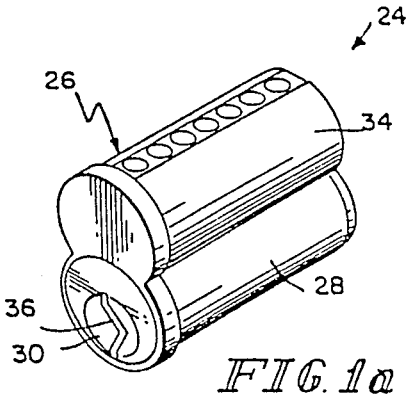
FIG. 1a is a perspective view of the interchangeable lock core illustrated in FIG. 1.

An interchangeable lock core 24 is illustrated in FIG. 1*a*. The interchangeable core 24 includes a core body 26. The core body 26 is desirably of FIG.-8 cross-section. It is within the scope of the present invention to use a different type of lock core. The core body 26 has a lower lobe 28 which contains a key plug 30 and a core sleeve 32 (See FIG. 6), and an upper lobe 34 which contains pin tumblers or segments (not shown). The key plug 30 is formed with an axial broached key slot 36 and is rotatably mounted within the core sleeve 32 (See FIG. 6). A conventional throw member and throw pin assembly (not shown) is rotatably mounted in the key plug 30 and is fixed to a lock-actuating cam 38 for transmitting key-plug rotation to a secondary lock mechanism, as is known in the art, and as shown in U.S. Pat. No. 1,564,463. The core body 26 is adapted to be mounted in the lock cylinder housing 12 as shown in FIGS. 1.

In the embodiment of FIGS. 1–3, the cylinder cap 14 is threadedly engaged to the forwardmost end 40 of lock cylinder housing 12. The cap 14 includes a forward face 42 and a rearward face 44. The cap 14 includes a key-way disc-receiving passageway 46 extending between the forward face 42 and the rearward face 44. The passageway 46 includes a radially inwardly projecting circumferential lip 48 having a rearwardly presented surface 50, and an interior surface 52. As shown in Fig. 1, the cylinder cap 14 is mounted to the lock cylinder housing 12 to cause the rearward face 44 to lie in confronting relation with the lock cylinder housing 12.

The lock cylinder housing 12 further includes a longitudinal bore 54 having an opening in the outer face 56 of the lock cylinder housing 12. The cylinder cap 14 includes a pin-receiving recess 58 formed in the rearward face 44 of the cylinder cap 14. A blocking pin 60 is received in the longitudinal bore 54 for free rotation therein. The blocking pin 60 is extendable through the bore opening to engage the recess 58 in the cylinder cap 14. Extension of pin 60 is limited by chamfer 62 illustrated in FIG. 1. A setscrew 64 is threadedly received in the longitudinal bore 54 and extendable therein to urge the freely rotatable blocking pin 60 toward its engaged position in the cylinder cap 14 to block rotation thereof. The blocking pin 60 spins freely when drilled to complicate backing off the setscrew 64 to violate the security of the lock.

A key-way disc 66 includes a cylinder member 68 and a flange 70. The cylinder member 68 includes an exterior surface 72 and is formed to include a key slot 74 for alignment with the key slot 36 of the key plug 30. The key slot 74 opens radially outwardly through the exterior cylindrical wall 72 of the cylinder member 68. The flange 70 includes rib member 76 and a novel bridge member 78. The rib member 76 extends radially outwardly from the exterior cylindrical wall 72 of the cylinder member 68. The bridge member 78 is integrally coupled to the rib member 76 as best shown in FIG. 2. The function of the novel bridge member 78 is to cover a portion of the longitudinal opening 80 of the key slot 74 in the exterior cylindrical wall 72 of the cylinder member 68.

The key-way disc 66 is retained within the passageway 46 of the cylinder cap 14 by means of a wire spring 82 or the like. In a preferred embodiment, the cylinder member flange 70 includes a radially outwardly facing surface 84 formed to include a circumferential wire-receiving groove 86. The wire spring 82 is received in groove 86 for fix the key-way disc 66 in the passageway 46 by means of a snug fit among the exterior surface 84, the wire spring 82, and the interior surface 52 of the cylinder cap passageway 46. In its retained position, the flange 70 abuts the rearwardly presented surface 50 of the cap lip 48 so that the bridge member 78 is protectively captured intermediate the cylinder cap 14 and the lock cylinder housing 12. The bridge member 78 advantageously prevents a lock-attacker from drilling or breaking an exposed portion of the key-way disc 66 to cause the disc to collapse inwardly about its key slot 74 so that the lock-attacker can pry the disc 66 out of the passage 46 in the cylinder cap 14 to gain access to the key plug 30.

The cylinder ring 16 is installed intermediate the cylinder cap and lock cylinder housing assembly and the ascutcheon 22 to protect the interchangeable core 24 from attack. The cylinder ring 16 includes a contoured interior wall 90 as shown best in FIG. 3. The interior wall 90 includes a circumferential V-shaped groove 92. The V-shaped groove 92 has an opening in the interior wall 90 such that the groove opens toward the exterior surface 94 of the lock cylinder housing 12 and toward a radially outwardly presented surface 96 of the cylinder cap 14.

The stainless steel cylinder ring 16 is heat-treated using a conventional ion nitride heat-treating process to case harden the outer surface to a certain depth as indicated by reference numeral 98 to resist attack as by drilling. Internally, the heat-treated cylinder ring 16 remains soft and non-brittle to resist breakage. Thus, the cylinder ring 16 is drill resistant and also not brittle. It will be appreciated that surfaces 100, 102 of the V-shaped groove are also case-hardened during the ion nitride process. Thus, a drill in use to attack and split cylinder ring 16 along line 104 will encounter not only hardened exterior surface 106, but also the pair of hardened groove surfaces 100 and 102 as shown in FIG. 3. The cylinder ring 16 can resist drilled attack even if hardened surface 106 is penetrated by a center punch to expose the softer interior 108 since the drill bit will still encounter hardened surfaces 100 and 102. These surfaces 100 and 102 are angled in respect to the direction of drill travel 104 to "cam" the drill bit along the surface and break it. The harder the lock-attacker forces the drill bit to penetrate either of angled hardened surfaces 100 and 102, the more likely it is that the drill bit will be broken.

Figure 5:
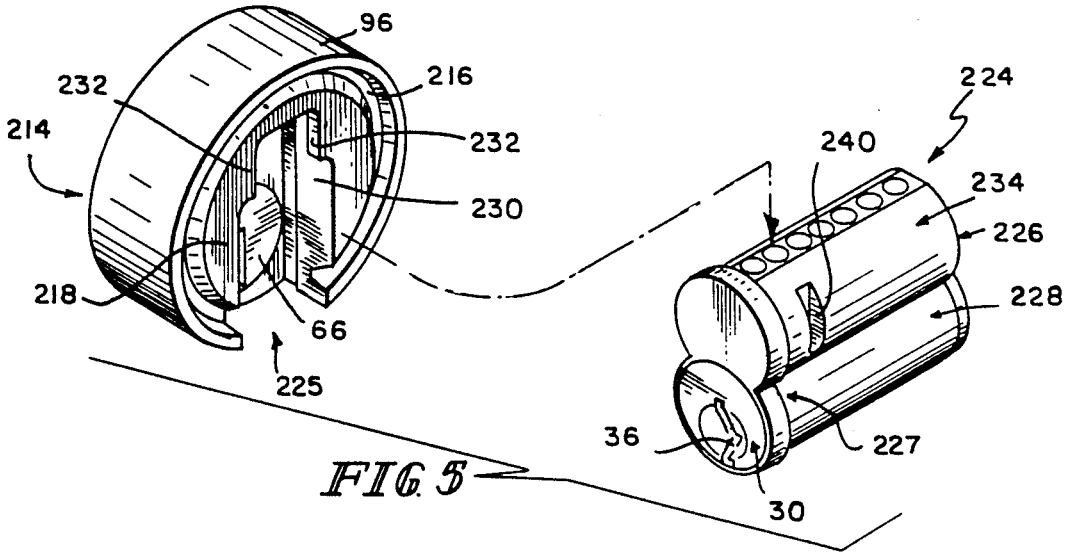
FIG. 5 is an exploded perspective view of a portion of the lock illustrated in FIG. 4 showing the assembly of the cylinder cap onto the interchangeable lock core.
Figure 6:
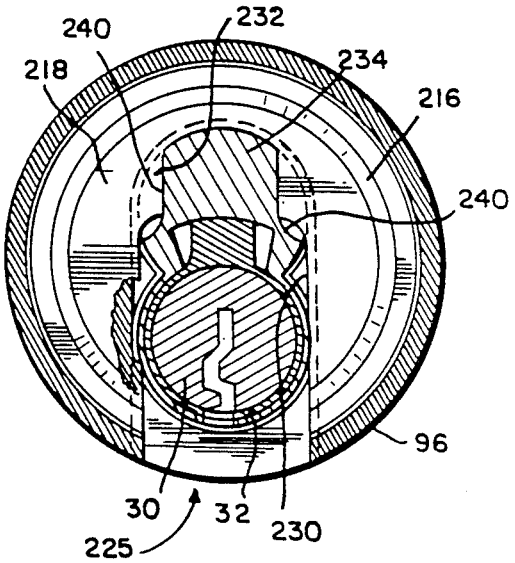
FIG. 6 is a transverse section of the embodiment shown in FIG. 4 taken along lines 6—6 of FIG. 4 with portions broken away.

In the embodiment of the invention illustrated in FIGS. 4–6, those elements numbered identically with the embodiment of FIGS. 1–3 perform the same or similar functions. In the embodiment of FIGS. 4–6, the threaded cylinder cap 14 which is threadedly engageable with the lock cylinder housing 12 is replaced by an unthreaded cylinder cap 214 which is slidably engageable with the modified upper lobe 234 of the key-removable interchangeable lock core 224 of IG.-8 cross section. Thus, cylinder cap 214 is removable from its lock-protecting position shown best in FIG. 4 solely by means of the control key (not shown) used to remove the interchangeable lock core 224 from its chamber in the lock cylinder housing 212.

The key-removable cylinder cap is designed to include a flange-receiving recess 216 formed in the rear face 218 thereof. The lock cylinder housing 212 includes a flange 222 along a radially outer portion of its forward face 223. The cylinder cap 214 is formed to include a cavity 225 for receiving a forward portion 227 of the core body 226. The cavity 225 includes a side wall 230 for embracing the exterior surface of the upper lobe 234 of the core body 226. The cylinder cap 214 further includes a pair of flanges 232. Each flange 232 extends radially inward from the side wall 230 so that the flanges 232 confront one another in spaced-apart relation as best shown in FIG. 5. The upper lobe 234 of the core body 226 is formed to include a pair of flange-receiving slots 240 as best illustrated in FIG. 5.

Assembly of the cylinder cap 214 onto the interchangeable lock core 224 is accomplished by first installing the key-way disc 66 into the passage 46 of the cylinder cap 214. Then the cap 214 is mounted by sliding the cap 214 onto the forward end 227 of the core 224 as shown in FIG. 5 to cause the pair of confronting flanges 232 to engage the slots 240 in the upper lobe 234 of the core body. Once assembled, the cap/lock core assembly can be installed in the core receptacle 236 by using the control key (not shown) to operate the control lugs 238 to move the lugs 238 to a core-retaining position.

Figure 8:
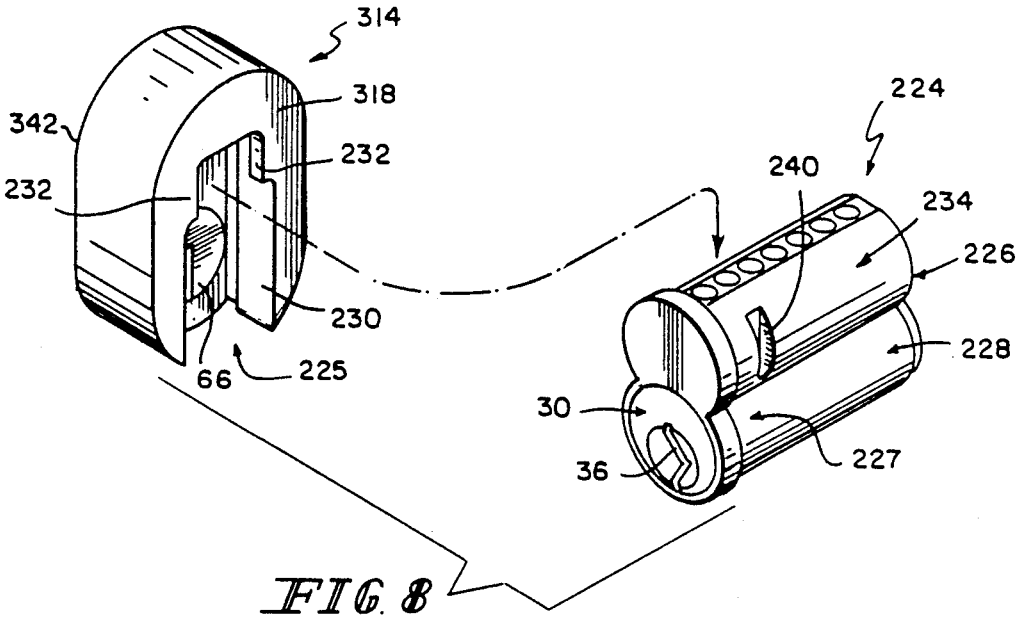
FIG. 8 is an exploded perspective view of a portion of the lock illustrated in FIG. 7 showing the assembly of the padlock cap onto the interchangeable lock core.
Figure 7:
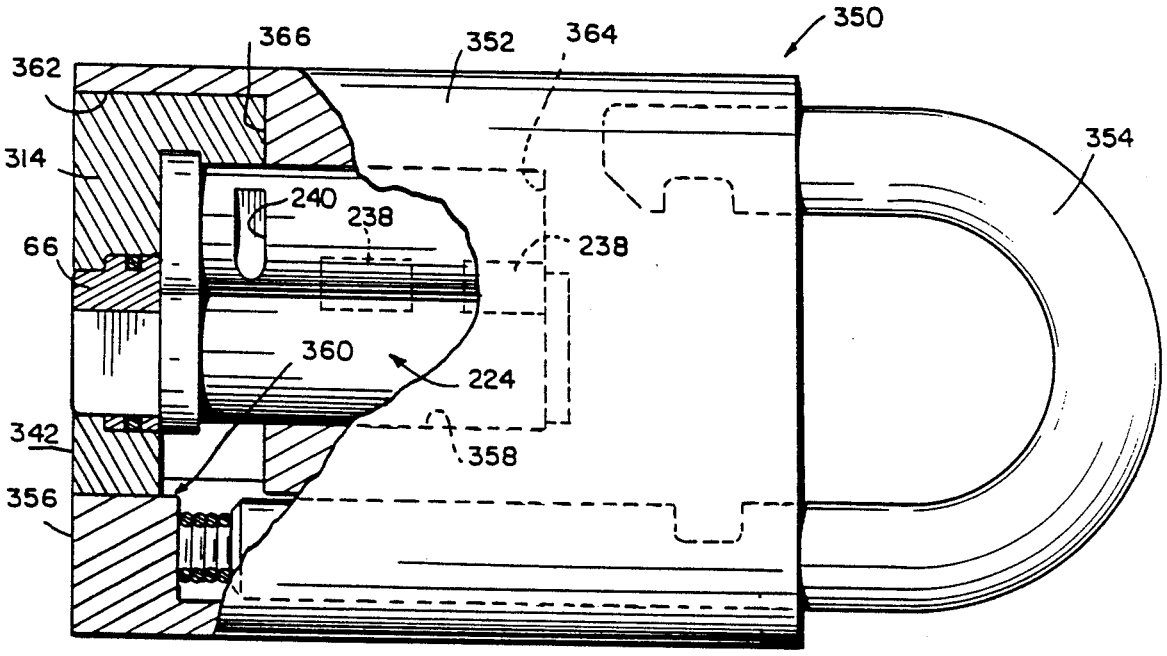
FIG. 7 is a top plan view of a padlock incorporating yet another of the preferred embodiments of the present invention with portions broken away showing a key-removable padlock cap mounted on an interchangeable lock core.

In the embodiment of the invention illustrated in FIGS. 7 and 8, those elements numbered identically with the embodiments of FIGS. 1–6 perform the same or similar functions. In the embodiment of FIGS. 7 and 8, a cap and core assembly is installed in a padlock 350 having a padlock case 352 and a shackle 354. The padlock case 352 includes a bottom end wall 356 and is formed to include a deep chamber 358 of FIG.-8 cross section for the reception of the interchangeable lock core 224 and a shallow chamber 360 of generally oval cross section for the reception of a padlock cap 314 mounted on core 224. Both chamber 358 and 360 are accessible via an opening 362 formed in the bottom end wall 356 of the padlock case 352. An outwardly presented surface 364 is defined by the bott;om wall of the deep core-receiving chamber 358. The padlock cap 314 includes a rear face 318 and forward face 342 as well as other features 225, 230, and 232 described in connection with the embodiment of FIGS. 4–6.

Assembly of the padlock cap 314 onto the interchangeable lock core 224 is accomplished by first installing key-way disc 66 in the padlock cap 314. Then the cap 314 is mounted by sliding the cap 314 onto the forward end 227 of the core 224 as shown in FIG. 8 to cause the pair of confronting flanges to engage the slots 240 in the upper lobe of the core body. Once assembled, the cap/lock core assembly can be installed in the padlock case 350 by positioning the rearward end of the core 224 in the deep chamber 358 to seat against the outwardly presented surface 364 and the padlock cap 314 in the shallow chamber 360 to seat against a ledge 366 in the padlock case 352, and by using the control key (not shown), to move the control lugs 238 to a core-retaining position. In its mounted position in the shallow chamber 360, the forward face 342 of the padlock case is desirably flush with the bottom end wall 356 of the padlock case 352. One advantage of this embodiment of the present invention is that it provides a security shield that is sheltered in the interior of the padlock case and has a key face that is flush with the adjacent face of the padlock to protect padlock cores from being pulled from padlock case by means of a "nose-puller" or other lock attacking tool that is superior to conventional cage-like security shields or traps which are generally constructed using sheet metal components and embrace the exterior of the padlock case to protect the padlock core. Moreover, the padlock cap 314 of the present invention is conveniently removable by means of the control key in addition to providing an improved security shield.

Although the invention has been described in detail with reference to certain preferred embodiments and specific examples, variations and modifications exist within the scope and spirit of the invention as described and defined in the following claims.

What is claimed is:

1. A lock comprising a lock cylinder having an outer face, the cylinder being formed to include a bore having an opening in the outer face, a key plug rotatably received in the bore and formed to include a key slot, a cylinder cap having an inner face, the cylinder cap being mounted on the lock cylinder to position the inner face of the cap in closely-confronting relation to the outer face of the lock cylinder to protectively cover a portion of the outer face, the cylinder cap being formed to include a disc-receiving passageway extending between the outer and inner faces for alignment with a key plug, the cylinder cap having a radially inwardly projecting lip extending into the passageway, the cylinder cap further including flange means for lockably engaging the lock cylinder to block axial movement of the cylinder cap in relation to the lock cylinder, a rotatable key-way disc including a cylinder member having an exterior cylindrical wall and being formed to include a second key slot for alignment with the first key slot of the key plug, the second key slot opening radially outwardly through the exterior cylindrical wall, and flange means for engaging the radially inwardly projecting lip of the cylinder cap to rotatably mount the key-way disc in the disc-receiving passageway adjacent to the key plug, the flange means including a rib member extending radially outwardly from the exterior cylindrical wall of the cylinder member and a bridge member coupled to the rib member to cover a portion of the key slot opening in the exterior cylindrical wall of the cylinder member, and a cylinder ring having an interior wall for surrounding the exterior surfaces of the lock cylinder and cylinder cap to protect the cylinder and cap from external attack, the interior wall being provided by a layer of hardened material and formed to include a groove having an opening in the interior wall such that the cylinder ring groove opens toward at least one of the exterior surfaces of the lock cylinder and the cylinder cap when said cylinder and cap are surrounded by the cylinder ring.

2. A lock comprising a lock housing formed to include a core-receiving chamber, a lock core in the core-receiving chamber, the lock core including a core body of FIG. 8 construction having an upper lobe and an integral lower lobe, one of the upper and ower lobes being formed to include at least one transverse lug-receiving slot, and a lock cap having an interior side wall configured to define a transaxial cavity for receiving at least a forward portion of the core body, the lock cap including at least one transverse lug extending from the interior side wall into the transaxial cavity, each transverse lug engaging and entering into only one of the transverse lug-receiving slots formed in said one of the lobes upon insertion of the core body into the transaxial cavity of the cap so that the lock cap interlockingly engages the core body to protectively cover at least a portion of the lock core when the lock core is received in the lock housing to provide a security shield which cooperates with the lock housing to protect the core from being pulled from the housing or otherwise attacked.

3. The lock of claim 2, further comprising a key plug rotatably mounted in the core body, the key plug including a front face and being formed to include a first key slot having an opening in the front face for receiving an operating key, the cap further including an outer face and an inner face, the cylinder cap being formed to include a disc-receiving passageway extending between the outer and inner faces for alignment with the key plug, the passageway having a radially inwardly projecting lip, and a key-way disc including a cylinder member having an exterior cylindrical wall and being formed to include a second key slot for alignment with the first key slot of the key plug, the second key slot opening radially outwardly through the exterior cylindrical wall, and flange means for engaging the radially inwardly projecting lip of the cylinder cap to position the key-way disc in the disc-receiving passageway, the flange means including a rib member extending radially outwardly from the exterior cylindrical wall of the cylinder member and a bridge member coupled to the rib member to cover a portion of the key slot opening in the exterior cylindrical wall of the cylinder member, the rib member and bridge member cooperating to define a rearwardmost surface of the key-way disc that is positioned in substantially abutting relation to the front face of the key plug.

4. A lock comprising a lock cylinder having an outer face, the lock cylinder being formed to include a core-receiving chamber, a lock core in the core-receiving chamber, the lock core having a longitudinal axis, the lock core including a core body of FIG.-8 cross-section having an upper lobe and an integral lower lobe, the upper lobe having an exterior surface, the upper lobe of the core body being formed to include at least one lug-receiving slot having an opening in the exterior surface of the upper lobe, the lower lobe being formed to include a chamber for receiving a key plug, and a cylinder cap having an inner face, the cylinder cap being formed to include a cavity for receiving a portion of the core body, the cavity having a side wall for embracing the exterior surface of the upper lobe, the cylinder cap further including flange means depending from the inner face of the cylinder cap for engaging an exterior surface of the lock core to interlock the cylinder cap and the lock core against axial separation in opposing directions along the longitudinal axis of the lock core and to position the inner face of the cap in closely confronting relation to the outer face of the lock cylinder to protectively cover at least a portion of said outer face, the flange means including at least one lug for engaging said at least one lug-receiving slot in the upper lobe of the core body.

5. A lock comprising a lock cylinder, a key plug rotatably mounted in the lock cylinder, the key plug being formed to include a first key slot for receiving an operating key, a cylinder cap having an outer face and an inner face, the cylinder cap being formed to include a disc-receiving passageway extending between the outer and inner faces for alignment with the key plug, the cylinder cap having a radially inwardly projecting lip extending into the passageway, a key-way disc mounted in the disc-receiving passageway for rotation relative to the key plug, the key-way disc including a cylinder member having an exterior cylindrical wall and being formed to include a second key slot for alignment with the first key slot of the key plug, the second key slot opening radially outwardly through the exterior cylindrical wall, and flange means for engaging the radially inwardly projecting lip of the cylinder cap to position the key-way disc in the disc-receiving passageway adjacent to the key plug, the flange means including a rib member extending radially outwardly from the exterior cylindrical wall of the cylinder member and bridge member coupled to the rib member to cover a portion of the key slot opening in the exterior cylindrical wall of the cylinder member.

6. The lock of claim 5, wherein the lip includes a rearwardly presented surface, the cylinder cap is mounted to the lock cylinder to cause the rearwardly presented surface to lie in confronting relation with the lock cylinder, and further comprising means for retaining the key-way disc in the passageway to cause the flange means to abut the rearwardly presented surface so that the bridge member is protectively captured intermediate the cylinder cap and the lock cylinder.

7. The lock of claim 6, wherein the cylinder cap includes an interior surface configured to define the passageway, the flange means includes a radially outwardly facing exterior surface formed to include a recess, the exterior surface of the flange means being situated in closely-confronting relation to the interior surface of the cylinder cap and the retaining means includes a resilient member received in the recess to fix the key-way disc in the passageway by means of a fit among the exterior surface of the flange means, the resilient member, and the interior surface of the cylinder cap

8. A lock comprising a lock cylinder having an exterior surface, a cylinder cap mounted on the lock cylinder, the cylinder cap having a radially outward presented exterior surface, and a cylinder ring having an interior wall for surrounding the exterior surfaces of the lock cylinder and cylinder cap to protect the cylinder and cap from external attack, the interior wall being formed to include a groove opening toward the exterior surface of the cylinder cap, the groove being defined by first and second walls, each wall being oriented at an acute angle with respect to the exterior surface of the cylinder cap.

9. The lock of claim 8, wherein the groove extends about the circumference of the interior wall, thereby providing an annular barrier to attack.

10. A lock comprising a lock cylinder having an exterior surface, a cylinder cap mounted on the lock cylinder, the cylinder cap having a radially outwardly presented exterior surface, and a cylinder ring having an interior wall for surrounding the exterior surfaces of the lock cylinder and cylinder cap to protect the cylinder and cap from external attack, the interior wall being formed to include a second groove opening toward the exterior surface of the cylinder cap, the groove being defined by first and second walls, each wall being oriented at an acute angle with respect to the exterior surface of the cylinder cap, the groove being V-shaped and opening toward the radially outwardly presented surface of the cylinder cap, the groove being defined by first and second walls in substantially contiguous relation to the radially outwardly presented surface of the cylinder cap, each wall being provided by the layer of hardened material.

11. The lock of claim 10, wherein the cylinder ring has an exterior wall provided by the layer of hardened material.

* * * * *